US010202225B2

(12) United States Patent
Tamarindo

(10) Patent No.: US 10,202,225 B2
(45) Date of Patent: Feb. 12, 2019

(54) CAP WITH TOY DEVICE

(71) Applicant: GUALA PACK S.P.A., Castellazzo Bormida, Alessandria (IT)

(72) Inventor: Stefano Tamarindo, Alessandria (IT)

(73) Assignee: Guala Pack S.P.A., Castellazzo Bormida, Alessandria (IT)

( * ) Notice: Subject to any disclaimer, the term of this patent is extended or adjusted under 35 U.S.C. 154(b) by 581 days.

(21) Appl. No.: 14/648,054

(22) PCT Filed: Nov. 18, 2013

(86) PCT No.: PCT/IB2013/060220

§ 371 (c)(1),
(2) Date: May 28, 2015

(87) PCT Pub. No.: WO2014/083478

PCT Pub. Date: Jun. 5, 2014

(65) Prior Publication Data

US 2015/0307244 A1 Oct. 29, 2015

(30) Foreign Application Priority Data

Nov. 29, 2012 (IT) ..... BS2012A0167

(51) Int. Cl.

| | |
|---|---|
| ***B65D 51/00*** | (2006.01) |
| ***B65D 51/24*** | (2006.01) |
| ***B65D 41/34*** | (2006.01) |
| ***B65D 51/28*** | (2006.01) |
| ***B65D 55/00*** | (2006.01) |

(52) U.S. Cl.

CPC ..... *B65D 51/24* (2013.01); *B65D 41/3404* (2013.01); *B65D 51/28* (2013.01); *B65D 55/00* (2013.01)

(58) Field of Classification Search

CPC .... B65D 51/24; B65D 41/3404; B65D 51/28; B65D 55/00

USPC ..... 215/228

See application file for complete search history.

(56) References Cited

U.S. PATENT DOCUMENTS 2,792,696 A * 5/1957 Stayart ..... A47G 19/2227 215/11.1
3,051,341 A * 8/1962 Raynor Mead ..... A61J 9/00 215/11.1
4,007,936 A * 2/1977 Hornsby, Jr. ..... A63F 7/044 215/228

(Continued)

FOREIGN PATENT DOCUMENTS

CN 201154236 Y 11/2008
EP 1538105 A1 6/2005

(Continued)

OTHER PUBLICATIONS

International Search Report for PCT/IB2013/060220 dated Mar. 4, 2014.

(Continued)

*Primary Examiner* — Ernesto Grano
(74) *Attorney, Agent, or Firm* — Thomas|Horstemeyer, LLP

(57) ABSTRACT

A cap (1) with guarantee seal (14) for flexible packages (100) has a toy compartment (22, 44) and a ball (42) free to move by agitation of the cap, in the toy compartment (22, 44).

13 Claims, 8 Drawing Sheets

(56) References Cited

U.S. PATENT DOCUMENTS 5,375,828 A * 12/1994 Shikami ..... A47G 19/2227 273/110
5,439,103 A * 8/1995 Howes ..... B65D 5/4291 206/217
5,674,546 A * 10/1997 Barnes ..... B65D 81/3205 220/23.86
6,085,919 A * 7/2000 Singer ..... A63H 1/30 206/217
6,196,411 B1 * 3/2001 Nava ..... B65D 43/0212 206/217
6,447,356 B1 * 9/2002 Lapointe ..... A63H 33/28 446/15
6,766,902 B1 * 7/2004 Hartelius ..... B65D 51/28 206/217
7,055,709 B1 * 6/2006 Esau ..... A61J 7/0046 215/228
7,210,577 B2 * 5/2007 Swayne ..... B65D 51/28 206/217
7,503,563 B2 * 3/2009 Bowman ..... A63F 7/041 273/108
8,033,409 B2 * 10/2011 Lindemann ..... B65D 1/0284 215/10
8,113,364 B1 * 2/2012 Asadi ..... A61J 9/008 215/11.1
D663,203 S * 7/2012 Bodkin ..... D9/436
D684,056 S * 6/2013 Kwon ..... D9/452
D684,058 S * 6/2013 Kwon ..... D9/453
D686,495 S * 7/2013 Murray ..... D9/435
8,528,733 B2 * 9/2013 D'Hollander ..... B65D 43/169 206/457
D693,220 S * 11/2013 Luo ..... B65D 55/00 D9/439
8,708,181 B2 * 4/2014 Buck ..... A47G 19/065 220/253
D705,061 S * 5/2014 Jo ..... D9/435
8,727,149 B1 * 5/2014 Reid ..... B65D 41/26 215/228
8,727,150 B2 * 5/2014 Lemke ..... B65D 81/366 215/228
8,757,421 B2 * 6/2014 Yang ..... B65D 51/246 206/223
D712,266 S * 9/2014 Romer ..... D9/454
D712,744 S * 9/2014 Neputy ..... D9/454
8,960,466 B2 * 2/2015 Golden ..... B65D 51/2807 215/228
9,622,605 B2 * 4/2017 Buck ..... A47G 19/2205
2002/0144913 A1 * 10/2002 Falkenberg ..... B65D 17/502 206/217
2005/0184024 A1 * 8/2005 Santa Cruz ..... B65D 51/28 215/227
2006/0211330 A1 * 9/2006 Cahill ..... B65D 51/24 446/250
2008/0135513 A1 * 6/2008 Umenaka ..... B65D 41/3409 215/252
2011/0031208 A1 * 2/2011 Golden ..... B65D 51/245 215/228
2011/0139745 A1 * 6/2011 Ezra ..... B65D 51/24 215/305

FOREIGN PATENT DOCUMENTS

EP 2489605 A1 8/2012
WO 2008050361 A1 5/2008

OTHER PUBLICATIONS

Italian Search Report for IT BS20120167 dated Aug. 16, 2013.
English Translation of the Abstract for CN 201154236 published on Nov. 26, 2008.

* cited by examiner

CAP WITH TOY DEVICE

CROSS-REFERENCE TO RELATED APPLICATION

This application is the 35 U.S.C. § 371 national stage application of PCT Application No. PCT/IB2013/060220, filed Nov. 18, 2013, which claims priority to and the benefit of, IT Patent Application No. BS2012A000167, filed Nov. 29, 2012, both of which are herein incorporated by reference in their entirety.

SUMMARY

The present invention relates to a cap, for example plastic, for a bottle or container, in particular for containing drinks for children, such as fruit juices and purées, yoghurts, soft drinks etc. In particular, the present invention relates to a cap for flexible packages.

The present invention is particularly suitable for containers of drinks for children, in that it is provided with a guarantee seal which ensures that the package is intact and at the same time encourages the purchase of a package, in that the cap, once separated from the bottle or container, may be used as a toy.

Such purpose is achieved by a cap made according to claim 1.

DESCRIPTION OF DRAWINGS

The characteristics and advantages of the cap according to the present invention will be evident from the following description, made by way of a non-limiting example, with reference to the attached drawings, wherein.

DETAILED DESCRIPTION

Figure 1A:
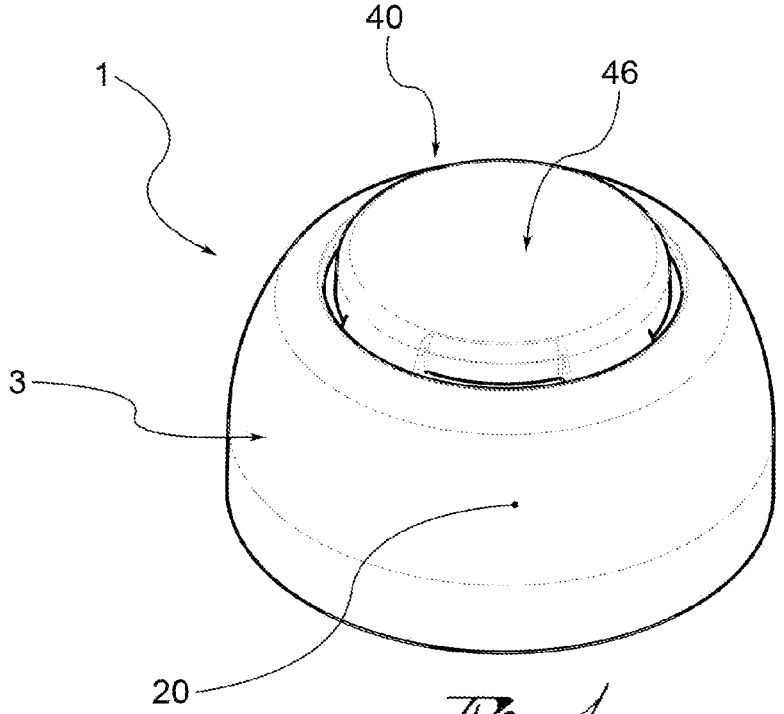
FIGS. 1*a* and 1*b* show a cap according to the present invention, in a view from above and below respectively, according to a first embodiment.
Figure 1B:
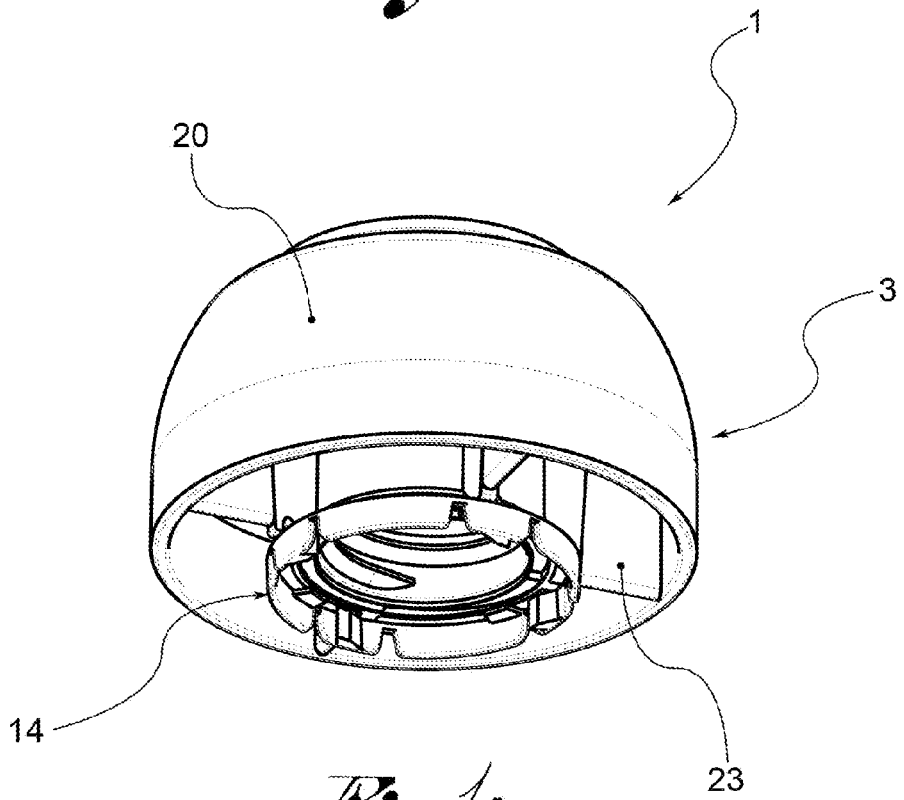
Figure 2:
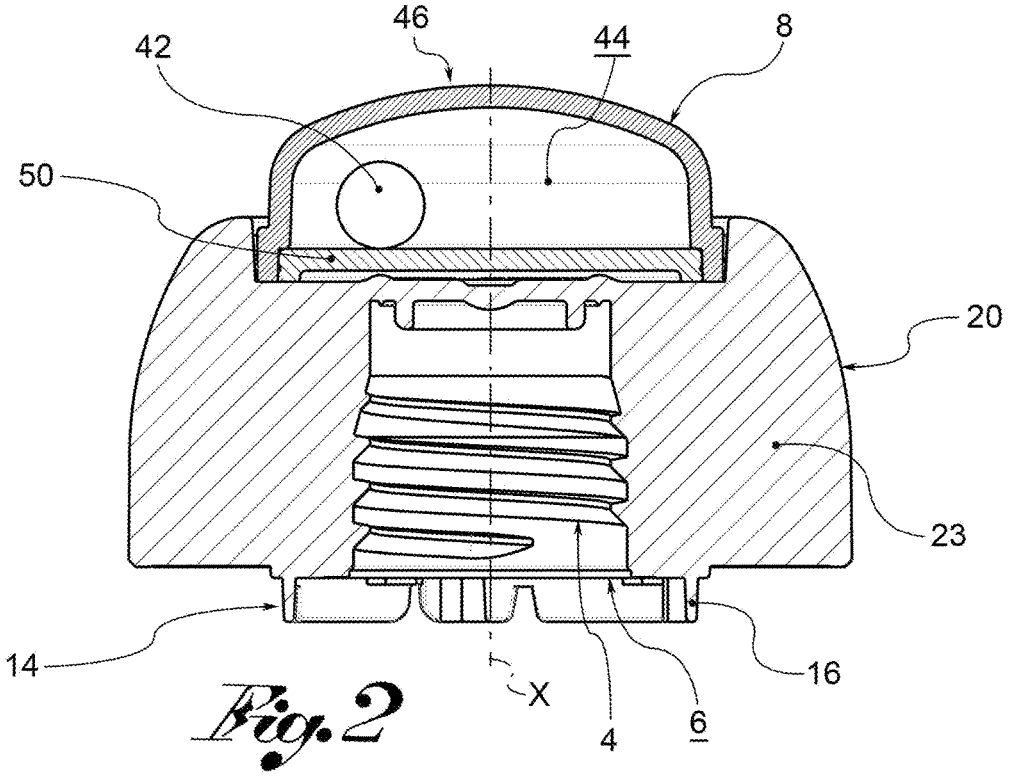
FIG. 2 shows a cross-section of the cap in FIGS. 1*a* and 1*b*, according to a first cross-section plane.
Figure 3:
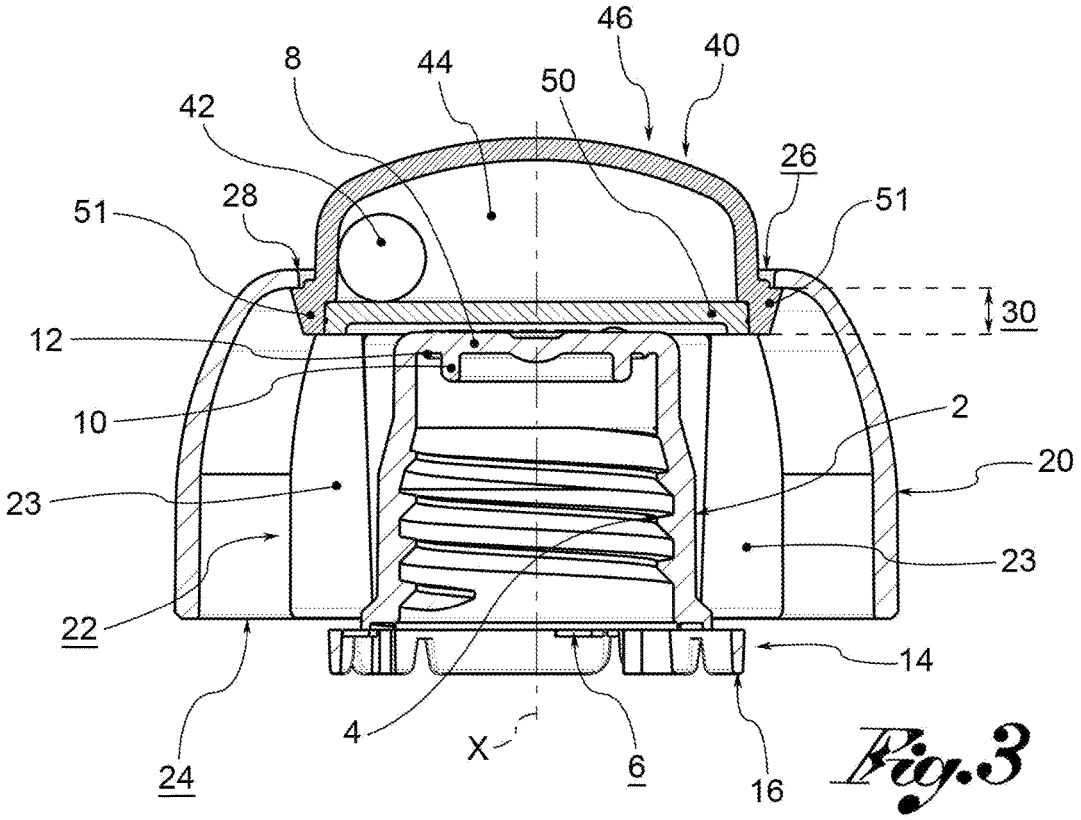
FIG. 3 shows a cross-section of the cap in FIGS. 1*a* and 1*b*, according to a second cross-section plane.
Figure 4:
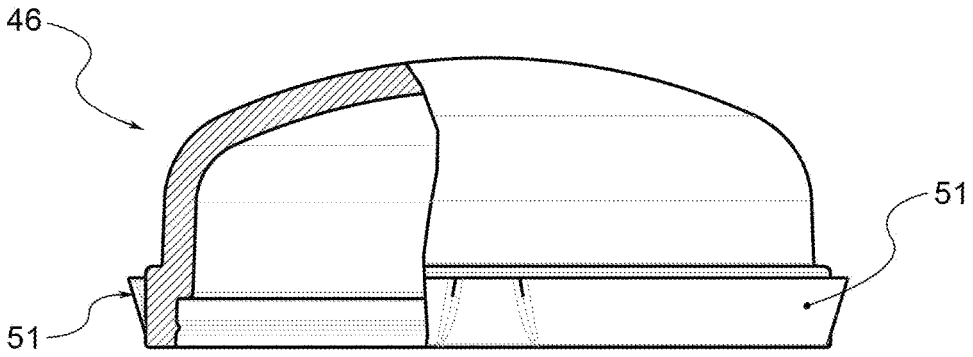
FIG. 4 shows a side view of a toy device applied to the cap according to the present invention.
Figure 5:
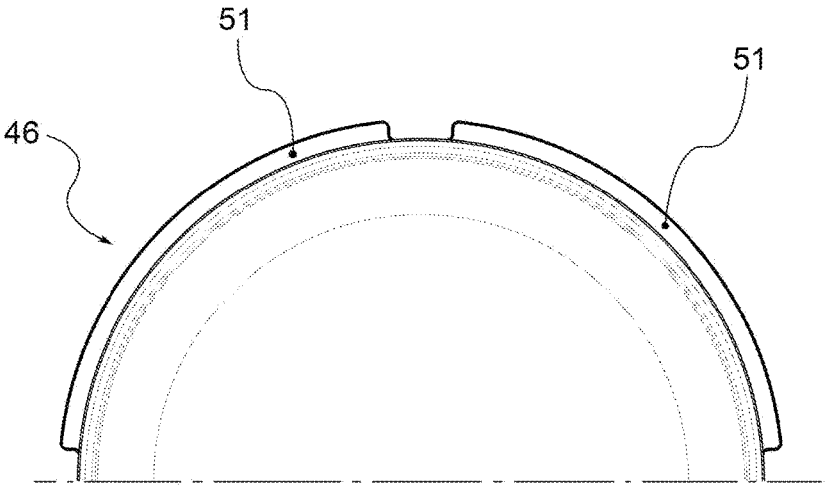
FIG. 5 shows a ground view from above of the toy device in FIG. 4.
Figure 6A:
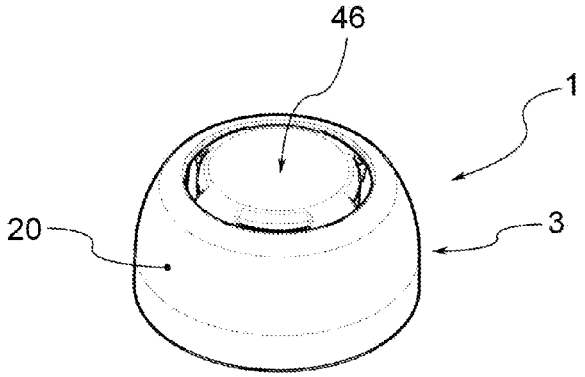
FIGS. 6*a* and 6*b* show a cap according to the present invention, in a view from above and below respectively, according to a further embodiment.
Figure 6B:
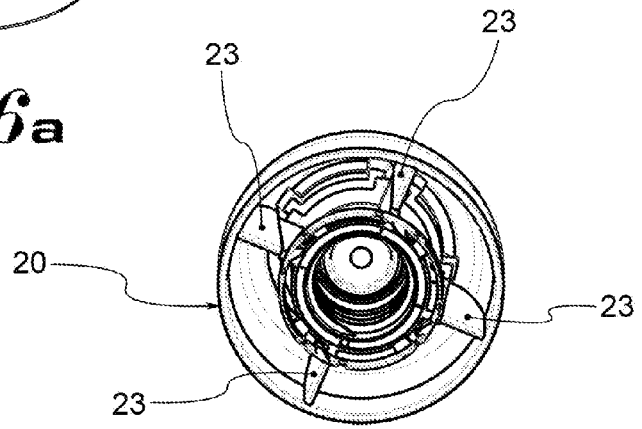
Figure 7:
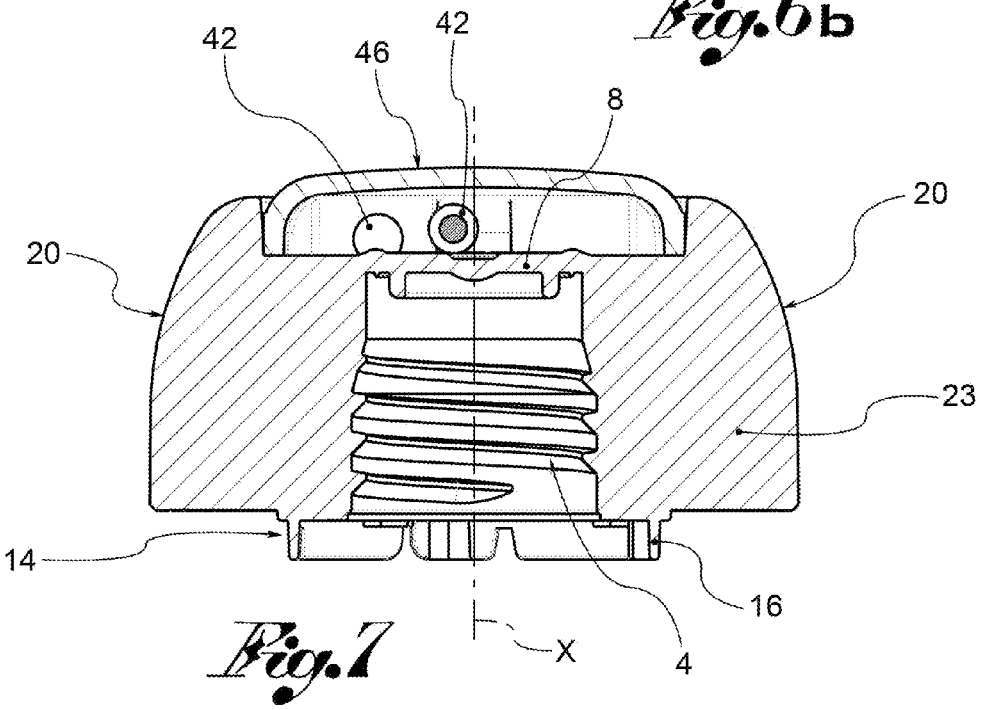
FIG. 7 shows a cross-section of the cap in FIGS. 6*a* and 6*b*, according to a first cross-section plane.
Figure 9:
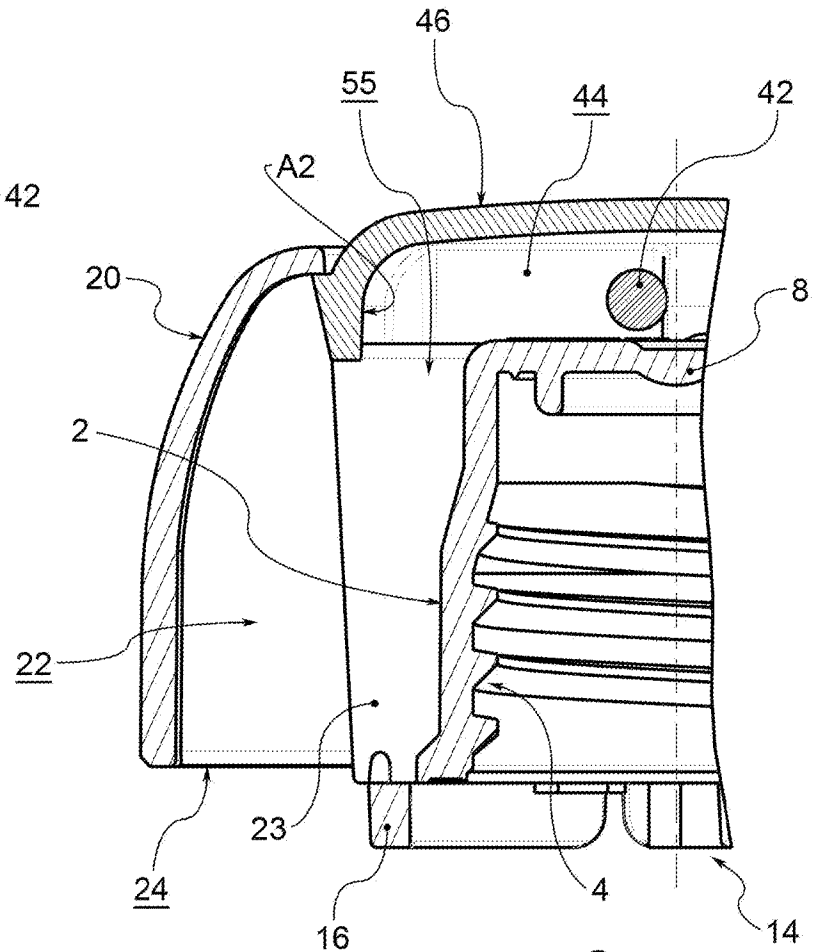
FIG. 9 shows a cross-section of the cap in FIGS. 6*a* and 6*b* according to a further cross-section plane.

With reference to the appended drawings, reference numeral 1 globally denotes a cap, preferably plastic, for the containers of children's drinks, such as fruit juices and purées, yoghurts, soft drinks and the like. In particular, the cap 1 is destined to close flexible packages, for example of the type shown in document EP-A1-1538105 in the Applicant's name.

Preferably, the flexible package comprises a container comprising two front walls, made with a sheet of flexible material, and possible sides, for example gussets, and a straw assembly comprising a straw, sealingly welded between the front walls of the container.

The cap 1 comprises a main body 3, comprising a tubular closure wall 2 which extends along a main axis X; the closure wall 2 is internally provided with a threading 4 for screwing to the container, and in particular for screwing to the straw thereof.

The side wall 2 extends from a lower end, where an entrance aperture 6 is present, which permits the insertion of the straw, to an upper end, where a bottom 8 which closes the wall 2 is present.

Preferably, the bottom 8 comprises internally a sealing assembly suitable to form the seal between said bottom 8 and the straw. For example, the sealing assembly comprises a pair of concentric sealing lips 10, 12 axially projecting from the bottom 8.

At the lower end, at the entrance aperture 6, the main body 3 comprises a guarantee seal 14, suitable for tearing in at least a portion when the cap 1 is unscrewed from the container.

For example, the guarantee seal 14 comprises an annular band 16, connected to the closure wall 2 in a plurality of connection points, comprising weakened portions suitable to break upon unscrewing of the cap 1 from the container.

In particular, the guarantee seal 14 is suitable to engage with resistant elements of the container, for example prominences projecting from the straw assembly, and said weakened portions are suitable to break as a result of relative rotation between the cap and said resistant elements.

One example of embodiment of a guarantee seal is described in the International Document WO-A1-2008/050361 in the Applicant's name.

Furthermore, the main body 3 comprises a gripping wall 20, continuous or composed of separate sections, which surrounds the closure wall 2. Preferably, the gripping wall 20 is radially distanced from the closure wall 2, forming a compartment 22 inside the cap.

The gripping wall 20 is connected to the closure wall 2; for example, the main body 3 comprises at least one tab 23, preferably three of or four angularly equidistant tabs, positioned in the inner compartment 22, which connect the gripping wall 20 to the closure wall 2.

According to a preferred embodiment, the gripping wall 20 extends axially from a lower end, for example at the height of the lower end of the closure wall 2, where a main aperture 24 in the form of a circular crown is present, which surrounds the closure wall 2 to an upper end, where an auxiliary aperture 26 is preferably present, delimited by a free rim 28 of said gripping wall 20.

According to a preferred embodiment, the gripping wall 20 extends axially above the bottom 8 or the closure wall 2. In other words, the free rim 28 and the auxiliary aperture 26 are positioned axially above the bottom 8 or the closure wall 2, so as to form between said bottom 8 or said closure wall 2 and said auxiliary aperture 26, an assembly compartment 30.

Preferably, the main body 3 is made in one piece for example of plastic material, for example by injection moulding.

The cap 1 further comprises a toy device 40 applicable to the main body 3, provided with at least one toy element 42, such as a ball, moving in a toy compartment of the device by agitating the cap.

For example, the toy device 40 is positioned at the free rim 28 of the gripping wall 20.

Preferably, the toy device 40 comprises a cover 46 having an auxiliary compartment 44, which the element 42 moves in.

According to a preferred embodiment, the cover 46, coloured or transparent, is at least partially transparent so that the toy element 42 contained therein is visible.

According to a further embodiment, the cover 46 is opaque, so that the toy element 42 is not visible, but the child can hear the noise made by the impact of the toy element 42 as it moves.

Preferably, the cover 46 is engaged with the gripping wall 20, and in particular with the free rim 28 thereof, to remain in position, thus positioning itself at least partially in the assembly compartment 30, preferably projecting at least partially externally thereto, to form for example a dome.

Preferably, the cap according to the present invention comprises safety passages for the passage of air through the cap in the case of swallowing, which at the top place the external environment in communication with the inner compartment 22.

For example, said safety passages are made between the toy device 40 and the free rim 28 of the auxiliary aperture 26.

According to a first embodiment of the invention, for example shown in FIGS. 1*a* to 5, the toy device 40 comprises an auxiliary base 50, for example in the form of a plate, for example disc-shaped, housed in the assembly compartment 30, preferably resting on the tab 23 of the main body 3.

According to said embodiment, the cover 46 is suitable for snap-engaging to the gripping wall 20, so as to also act on the auxiliary base 50, which remains retained between said cover 46 and the bottom 8 of the main wall 3.

In particular, to such purpose, the cover 46 comprises engagement tabs 51, which extend circumferentially, preferably separate from each other, projecting radially, suitable to snap-engage the gripping wall 20.

According to said embodiment, the toy compartment in which the toy element 42 moves, is delimited by said cover 46 and by the base 50 and corresponds to the auxiliary compartment 44.

According to a further embodiment, shown for example in FIGS. 6*a* to 10*b*, the toy compartment is defined by the cover 46 and by the main body 3, in particular by the bottom 8 of the closure wall 2 or by said closure wall 2 or by the tabs 23, so that between said cover 46 and said bottom 8 or said closure wall 2 or said tabs 23, passages 55 are made sufficiently narrow as not to be traversed by the toy element 42.

In other words, the toy element 42 has dimensions such as not to be suitable to traverse the passage 55 from the auxiliary compartment 44 to the inner compartment 22.

Figure 8:
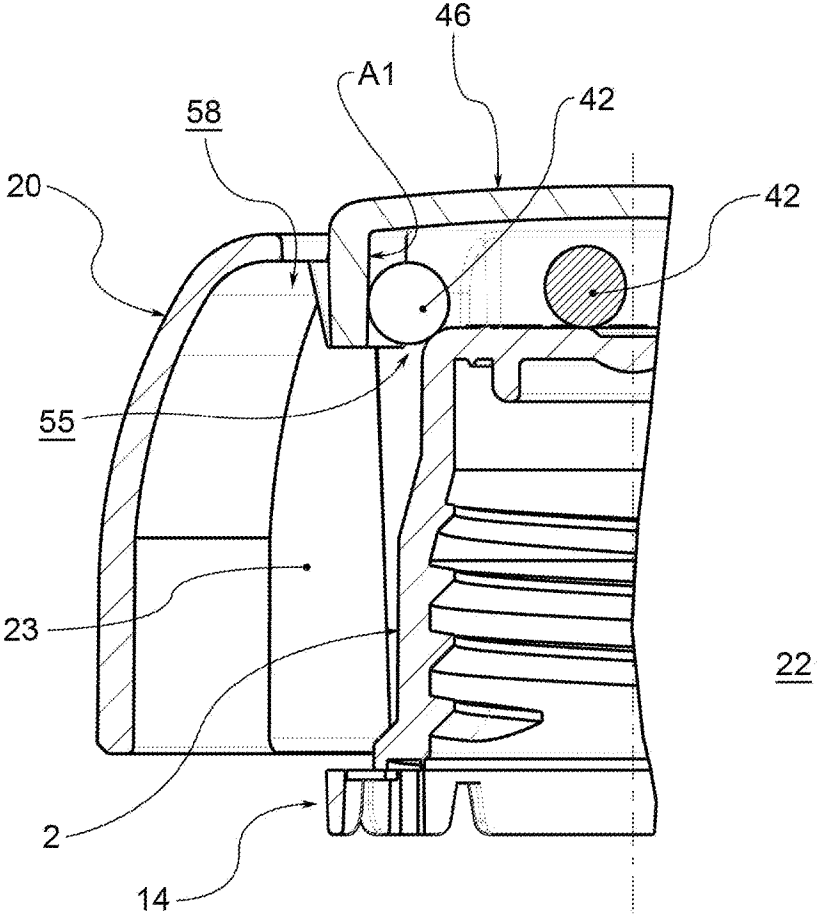
FIG. 8 shows a cross-section of the cap in FIGS. 6*a* and 6*b*, according to a second cross-section plane.
Figure 10A:
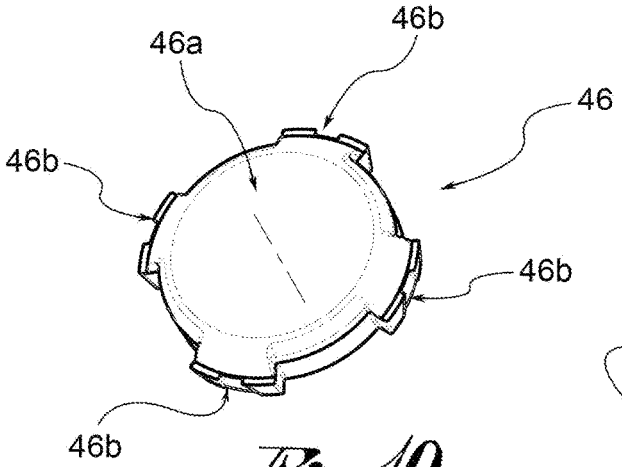
FIGS. 10*a* and 10*b* show a toy device applied to the cap according to the present invention, in a view from above and a view from below respectively.
Figure 10B:
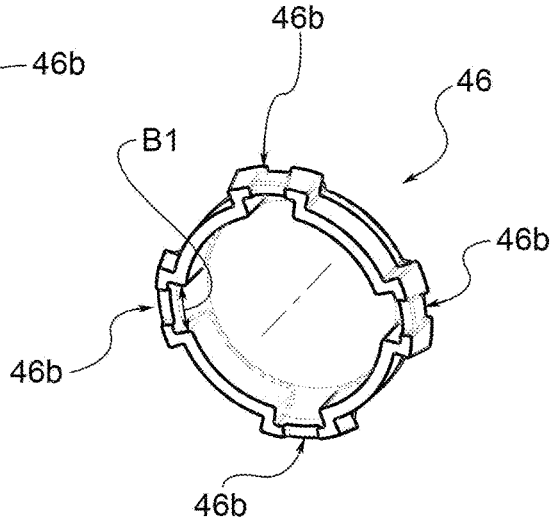
Figure 11A:
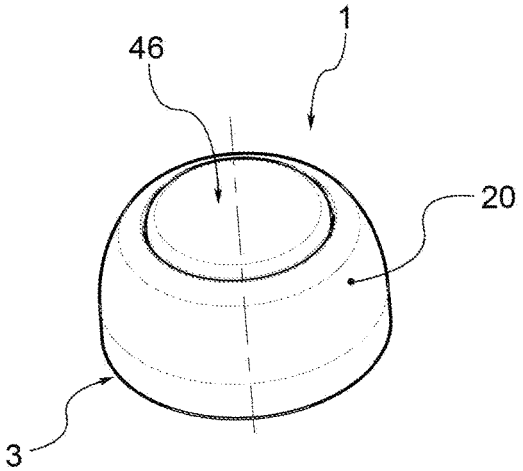
FIGS. 11*a* and 11*b* show a cap according to the present invention, in a view from above and below respectively, according to yet a further embodiment.
Figure 11B:
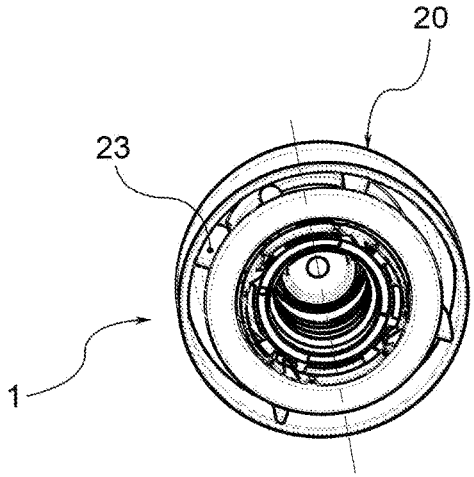
Figure 12:
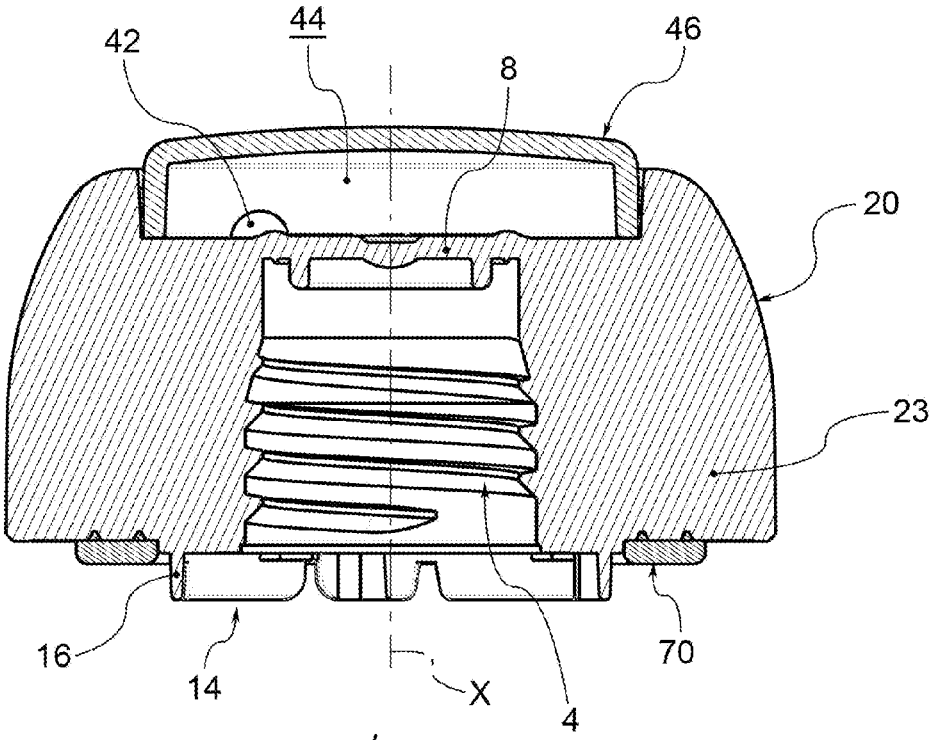
FIG. 12 shows a cross-section of the cap in FIGS. 11*a* and 11*b*, according to a first cross-section plane.
Figure 13:
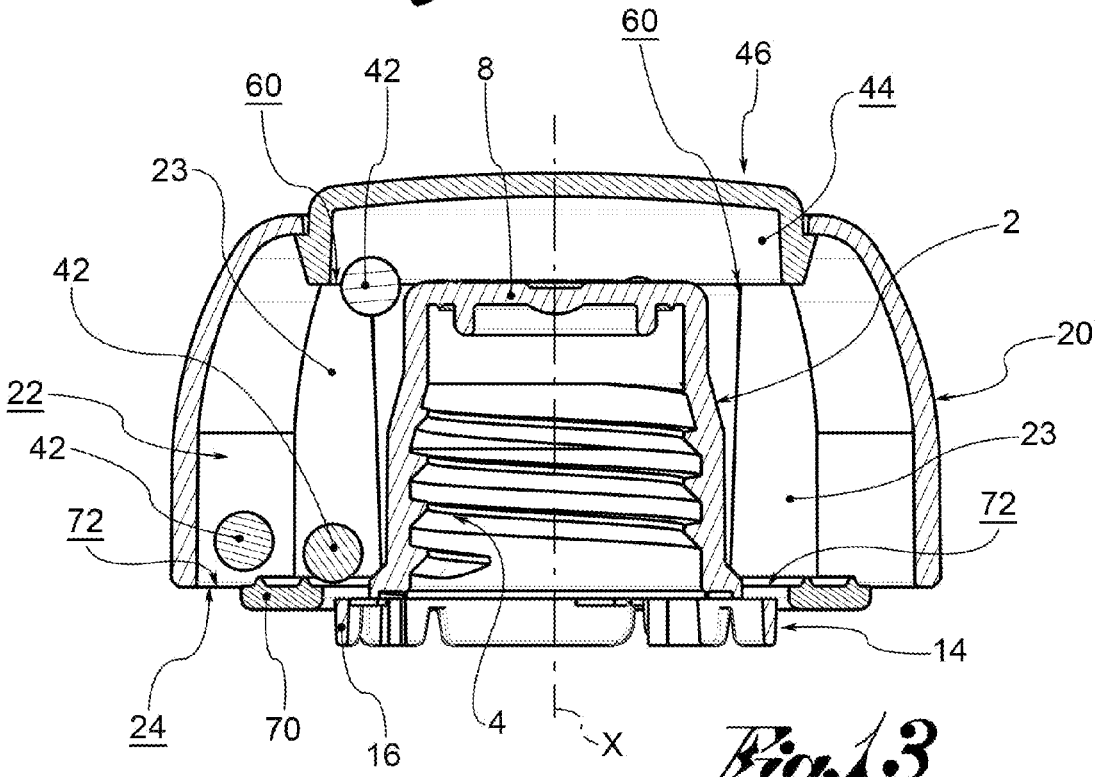
FIG. 13 shows a cross-section of the cap in FIGS. 11*a* and 11*b*, according to a second cross-section plane.

In particular, the cover 46 comprises a central portion 46*a* having internally a radial extension A1, for example a diameter, such as to form with the bottom 8 or the closure wall 2, the passages 55 not traversable by the toy element 42 (FIG. 8).

In addition, said cover 46 comprises engagement portions 46*b* projecting radially from the central portion 46*a*, having internally a circumferential extension B1 such as to form with a respective tab 23, overlapping said engagement portion 46*b*, the passages 55 not traversable by the toy element 42 (FIG. 9), while preferably the inner radial extension A2 is greater than the inner radial extension A1 of the central portion 46*a*.

Said engagement portions 46*b* are externally suitable for snap-engaging with the gripping wall 20, while preferably the central portion 46*a* does not engage the gripping wall 20.

In addition, said engagement portions 46*b* are angularly distanced, for example angularly equidistant, so as to define between them, together with the central portion 46*a* and the free rim 28 of the auxiliary aperture 26, the safety passages 58 for the passage of air in the event of swallowing (FIG. 8).

According to a yet a further embodiment, for example shown in FIGS. 11*a* to 13, the auxiliary compartment 44 of the cover 46 is open towards the inner compartment 22 of the main body by means of passages 60, for example formed between the cover 46 and said bottom 8 or said closure wall 2 sufficiently wide as to be traversed by the toy element 42.

According to said embodiment, the inner compartment 22 is closed toward the outside of the toy element 42. For example, the cap 1 comprises an annular delimiting strip 70, positioned at the main aperture 24, so as to form secondary passages 72 not traversable by the toy element 42.

For example, the delimiting strip 70 forms said secondary passages 72 co-operating with the closure wall 2 or with the guarantee seal 14 or with the gripping wall 2.

Preferably, the delimiting strip 70 is snap-fastened to the tabs 23 of the main body 3. [005*] According to a further embodiment, the delimiting strip completely closes the main aperture 24 of the inner compartment 22.

According to said embodiment, the toy compartment is composed of the auxiliary compartment 44 delimited by the cover 46 and by the inner compartment 22 of the main body 3.

Figure 14:
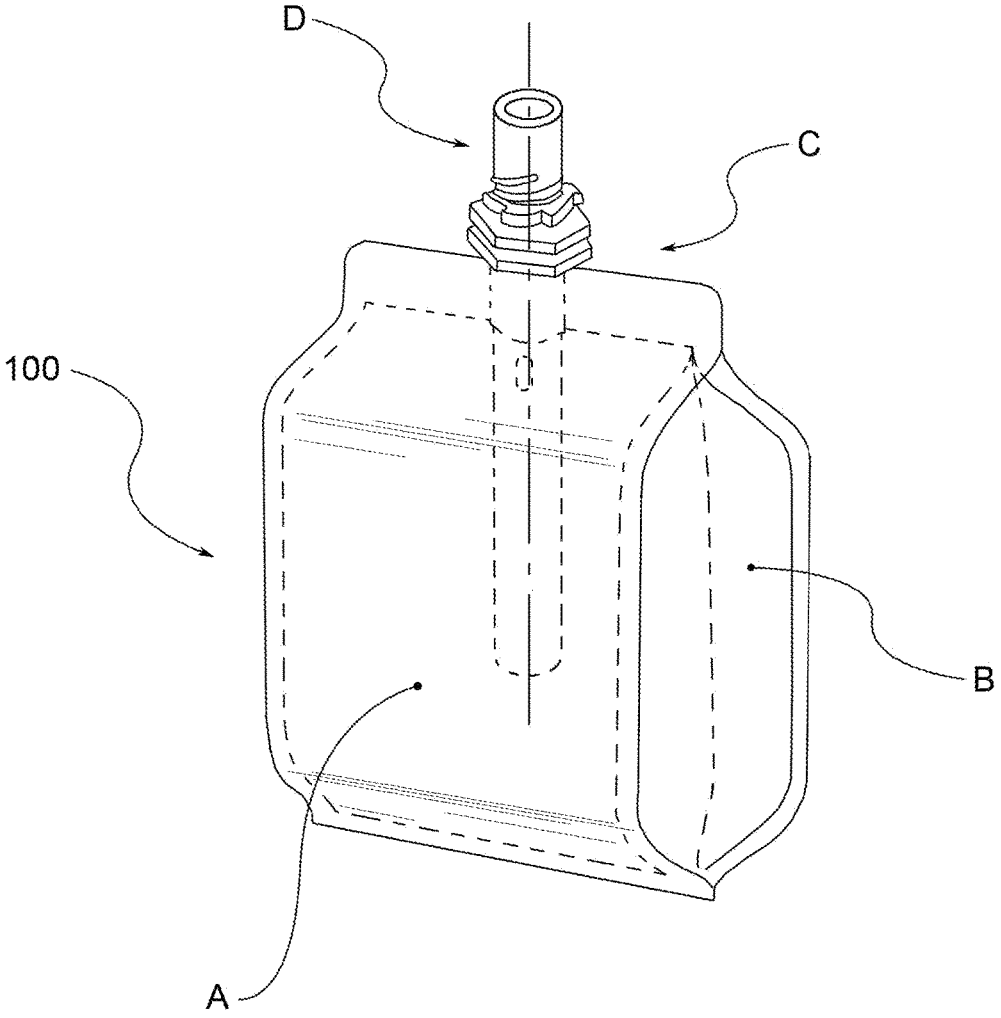
FIG. 14 shows a variant of a container and a straw assembly, comprising a straw of a flexible package, to which a cap made according to the present invention may be attached.

By way of example, FIG. 14 shows a container 100, comprising two front walls A made with a sheet of flexible material, joined by sides B and a straw assembly C, comprising a straw D, sealingly welded between the front walls of the container, to which the cap 1 according to the invention is applicable, to form the flexible package.

Innovatively, the cap according to the present invention makes a container or a bottle eye-catching especially in the eyes of a child, in that the cap can be used as a toy. In particular, by moving the cap a sound is made by the toy element which is also visible from the outside.

It is clear that a person skilled in the art may make modifications to the cap described above so as to satisfy contingent requirements all contained within the sphere of protection as defined by the appended claims.

The invention claimed is:

1. A cap for a container, in particular for containing liquid foods, in particular for children, comprising:

a main body comprising:

a) a tubular closure wall, closed on one side and provided with an entrance aperture on the other, internally provided with a threading for screwing the cap to the container;

b) a guarantee seal, joined in rotation with the tubular closure wall, engageable with resistant elements of the container and provided with breakable portions for the rotation of the cap in relation to the resistant elements;

c) a gripping wall which surrounds the tubular closure wall, radially distant and integral in rotation with the tubular closure wall, so as to define therewith an inner compartment open towards the outside on the side of the entrance aperture by means of a main aperture and on the other side by means of an auxiliary aperture having a free rim;

safety passages made above to allow the passage of air from the outside in the event of swallowing;

wherein the cap comprises a toy device having a toy compartment and a toy element free to move by agitation of the cap in the toy compartment and confined therein, wherein the safety passages are made between the toy device and the free rim of the auxiliary aperture, wherein passages are made between the toy compartment and the inner compartment, and wherein the toy element has dimensions such as not to be suitable to traverse the passage from the toy compartment to the inner compartment.

2. The cap according to claim 1, wherein the main body comprises at least one tab which connects the gripping wall to the tubular closure wall, housed in the inner compartment.

3. The cap according to claim 1, wherein the toy device comprises a cover applied to the main body, wherein the cover delimits at least partially the toy compartment.

4. The cap according to claim 3, wherein the cover is at least partially transparent to sight or opaque.

5. The cap according to claim 3, the passages are made between the cover and the tubular closure wall towards the inner compartment.

6. The cap according to claim 3, wherein the main body comprises at least one tab which connects the gripping wall to the tubular closure wall, housed in the inner compartment, and wherein between the cover and the at least one tab, passages are made towards the inner compartment, the passages being sufficiently narrow as not to be traversed by the toy element.

7. The cap according to claim 3, wherein the cover is suitable to snap-engaging to the gripping wall.

8. The cap according to claim 7, wherein the cover comprises a central portion, not engaged with the gripping wall, and engagement portions, projecting radially from the central portion and suitable for snap-engaging with the gripping wall.

9. The cap according to claim 8, wherein the engagement portions are angularly distanced so as to define between them, together with the central portion and the free rim of the auxiliary aperture, the safety passages.

10. The cap according to claim 1, comprising an annular delimiting strip applied to the main body, to obstruct at least partially the main aperture of the inner compartment.

11. The cap according to claim 1, wherein the main body is made in one piece in plastic material.

12. A closure assembly comprising a straw and a cap suitable for screwing to the straw, wherein the cap comprises:

a main body comprising:

a) a tubular closure wall, closed on one side and provided with an entrance aperture on the other, internally provided with a threading for screwing the cap to the container;

b) a guarantee seal, joined in rotation with the tubular closure wall, engageable with resistant elements of the container and provided with portions breakable as a consequence of the rotation of the cap in relation to the resistant elements;

c) a gripping wall which surrounds the tubular closure wall, radially spaced and rotatable together with the tubular closure wall, so as to define therewith an inner compartment open towards the outside on the side of the entrance aperture by means of a main aperture and on the other side by means of an auxiliary aperture having a free rim;

safety passages made above to allow the passage of air from the outside in the event of swallowing;

wherein the cap comprises a toy device having a toy compartment and a toy element free to move by agitation of the cap in the toy compartment and confined therein, and wherein the safety passages are made between the toy device and the free rim of the auxiliary aperture, wherein passages are made between the toy compartment and the inner compartment, and wherein the toy element has dimensions such as not to be suitable to traverse the passage from the toy compartment to the inner compartment.

13. A flexible packaging comprising:

A) a container comprising two front walls made with a sheet of flexible material;

B) a straw assembly comprising a straw, sealingly welded between the front walls of the container;

C) a cap comprising:

a main body comprising:

a) a tubular closure wall, closed on one side and provided with an entrance aperture on the other, internally provided with a threading for screwing the cap to the container;

b) a guarantee seal, joined in rotation with the tubular closure wall, engageable with resistant elements of the container and provided with portions breakable as a consequence of the rotation of the cap in relation to the resistant elements;

c) a gripping wall which surrounds the tubular closure wall, radially spaced and rotatable together with the tubular closure wall, so as to define therewith an inner compartment open towards the outside on the side of the entrance aperture by means of a main aperture and on the other side by means of an auxiliary aperture having a free rim;

safety passages made above to allow the passage of air from the outside in the event of swallowing;

wherein the cap comprises a toy device having a toy compartment and a toy element free to move by agitation of the cap in the toy compartment and confined therein, and wherein the safety passages are made between the toy device and the free rim of the auxiliary aperture, wherein passages are made between the toy compartment and the inner compartment, and wherein the toy element has dimensions such as not to be suitable to traverse the passage from the toy compartment to the inner compartment.

* * * * *